United States Patent [19]

Andersson

[11] 4,088,165

[45] May 9, 1978

[54] PLANING TOOL

[76] Inventor: Allan V. T. Anderson, Kjellbergsgaten 6, S-411 22 Göteborg, Sweden

[21] Appl. No.: 735,492

[22] Filed: Oct. 26, 1976

[51] Int. Cl.[2] ..... B27G 17/02

[52] U.S. Cl. ..... 145/5 R; 145/16

[58] Field of Search ..... 145/5 R, 5 A, 16, 17, 145/11

[56] References Cited

U.S. PATENT DOCUMENTS

| | | | |
|---|---|---|---|
| 14,363 | 3/1856 | Mathers | 145/5 R |
| 72,443 | 12/1867 | Bailey | 145/16 |
| 165,884 | 7/1875 | Shogren | 145/5 R |
| 675,533 | 6/1901 | Verge | 145/5 R |
| 729,020 | 5/1903 | Vance | 145/5 R |
| 778,849 | 1/1905 | Ellis | 145/11 |
| 819,888 | 5/1906 | Jones | 145/5 R |
| 1,192,849 | 8/1916 | Bridges | 145/5 R |
| 1,239,197 | 9/1917 | Luskey et al. | 145/5 R |
| 2,550,377 | 4/1951 | Pratt | 145/5 R |
| 2,570,980 | 10/1951 | Powell | 145/11 X |

FOREIGN PATENT DOCUMENTS

| | | | |
|---|---|---|---|
| 88,962 | 4/1937 | Sweden | 145/5 R |

*Primary Examiner*—Gary L. Smith
*Assistant Examiner*—J. T. Zatarga

[57] ABSTRACT

Planing tool comprising a front part movably connected to a rear part and having surfaces which face each other and are movable towards and away from each other, said surfaces being inclined in the direction of forward push of the tool and having means for fixing a bit therebetween, said surfaces and consequently said parts of the tool relative to each other, and means for mutually pressing together said surfaces and locking said parts of the tool together with the bit clamped and fixed with respect to its position between said surfaces.

10 Claims, 6 Drawing Figures

PLANING TOOL

The present invention relates to a planing tool by which preferably one time bits are used.

It is a principal object of the invention to provide a planing tool of the kind mentioned, which is simple to handle also for an unskilled person without difficult operations for change and adjustment of the planing bit. It is another object of the invention to provide a planing tool, which is easy to clean from shavings, which have not stuck in the shavings slit.

Said objects are reached by means of a planing tool made according to the invention, which subsantially is characterized by comprising a rear part and a front part, which are detachably and/or in hinged manner connected with each other, the two parts at the junction each one exhibiting its plane extending in crosswise direction to the planing tool, which plane in the direction of forward push of the planing tool has an inclination, which substantially corresponds the desired inclination of the cutting unit of the planing tool, which is equipped with means for one thing for the fixation of the cuting unit and the two planes and consequently the two parts of the planing tool relative to each other, and for another thing means for the mutual pressing together of the two planes in order that they in between them hold together the two parts of the planing tool with the cutting unit pressed and fixed with respect to its position between said planes.

Figure 1:
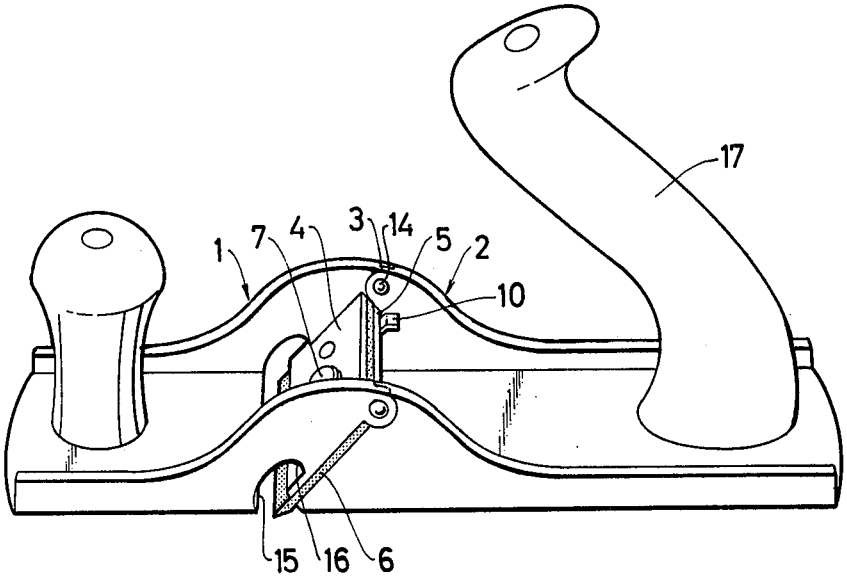
Figure 2:
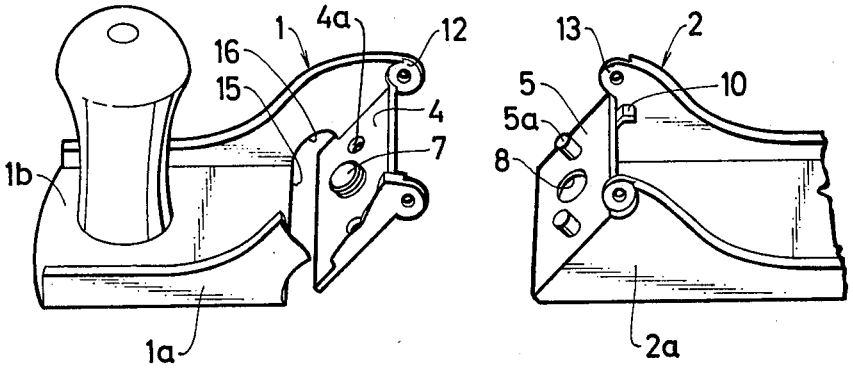
Figure 3:
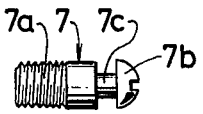
Figure 4:
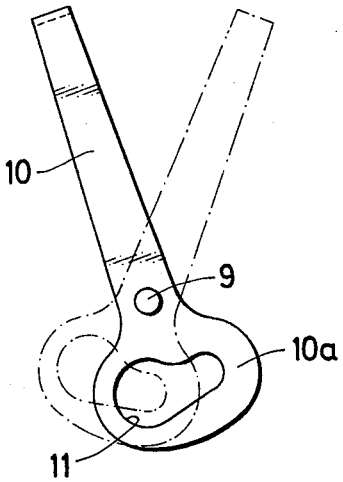
Figure 5:
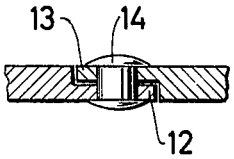
Figure 6:
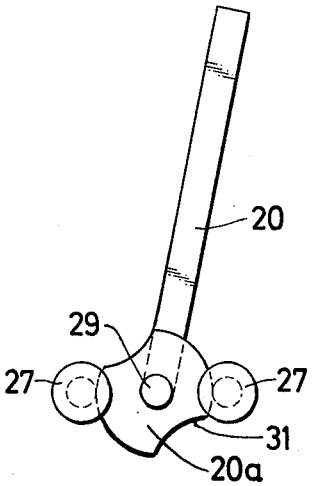

In the following an example of an embodiment of the object of the invention will be described, reference being made to the accompanying drawing, in which FIG. 1 is a perspective view as seen diagonally from above of a planing tool made according to the invention, FIG. 2 is a perspective view corresponding the one in FIG. 1 of the same planing tool in disassembled condition, FIG. 3 shows a detail forming part of the planing tool, FIG. 4 shows another detail forming part of the same planing tool, FIG. 5 shows still another detail forming part of the planing tool, and FIG. 6 illusrates an alternative embodiment of the detail shown in FIG. 4.

The planing tool illustrated in the drawing comprises two principal parts, of which the front part in its entirety is indicated with 1, and the rear part in its entirety is indicated with 2. The two princpal parts in the assembled condition illustrated in FIG. 1 are in between them connected by means of a hinge 3. The two principal parts exhibit a U-shaped cross-section, the grooves formed by the U-shape being closed at one end by means of a transversal rear endwall 4 as regards the front part and a correponding transversal front wall 5 as regards the principal rear part 2. The two end walls 4 and 5 exhibit the shape of plates, which in the forward pushing direction of the planing tool occupy an inclination, which substantially corresponds the inclination of the actual bit unit 6. The endwall of the front part 1 exhibits two holes **4*a*, which are interspaced in sidewise direction and with respect to their location and dimension correspond guide pins 5*a* projecting from the end wall 5 of the rear part 2. Moreover a locking pin 7 is screwed from the rear into the endwall 4 of the front part, the appearance of which locking pin is best evident from the FIG. 3. The locking pin 7 at one of its ends is provided with a thread 7*a*, which in mounted condition engages a corresponding thread in the endwall plate 4. At its other end said locking pin exhibits a head 7*b* provided with a groove, inside which an annular groove 7*c* is made, the wall of which groove, forming the underside of the side 7*b*, being somewhat oblique, whereby the groove in direction to its bottom exhibits a tapering shape. In the rear end-wall plate 5 a hole 8 is made corresponding the pin 7, and at the rear side of the plate 5 a locking arm 10 is pivotably mounted on a pivot 9, said locking arm exhibiting the shape of a double-armed lever, one leverarm 10 of which being shaped as a plate and exhibiting an opening 11 similar to a key hole, the wider, portion of which exceeds the diameter of the head 7*b* of the locking pin, and the smaller portion of which exhibiting a width, which is smaller than the diameter of the head 7*b*, but exceeds the diameter of the portion thereof, which forms the bottom of the groove 7*c*. The lateral flanges of the principal parts 1 and 2 indicated with 1*a* and 2*a* respectively at the hinge are provided with ears 12 and 13 respectively, which project past the end wall plates 4 and 5 respectively, which ears in the mounted condition illustrated in FIG. 1 are kept together by means of rivets 14, which form the hinge, which in FIG. 1 is indicated with 3. The bit unit 6 used in the planing tool exhibits holes corresponding for one thing the guiding pins 5*a* and for another thing the locking pin 7. The mounting of the bit unit is made by threading the same on the pins 5*a*, the two principal parts 1 and 2 thereby being pivoted out from each other, whereafter said parts are pivoted into the position illustrated in FIG. 1, whereby the locking pin 7 is inserted through the bore 8 and into the wider portion of the opening 11 of the arm 10, whereafter the arm 10 is pivoted round the pin 9, so that its lower portion engages the head 7*b* of the locking pin and by wedge effect draws together the two end wall plates 4 and 5 in such a manner that the cutting unit is tightly pinched and held in place between said plates. Thereby the cutting unit is kept at the correct shavings depth by means of the guiding pins 5*a*. Between the bottom portion 1*b* of the front part and the end wall plate 4 the same exhibits an opening 15 for shavings, which in the lateral flanges 1*a* passes to lateral openings 16, the upper edges of which preferably are egg-shaped in order to facilitate the separation of the shavings when planing. By the egg-shape of the upper edge of the lateral openings 16** they can be made very small without this having any bad effect on the shavings separation. By the illustrated division of the planing tool it is made possible in a simple manner to use a cutting unit, which with respect to its design is very simple, and which exhibits the same width as the distance between its outer sides. This means that the planing can take place close to shoulders and the like.

By substituting the hinge rivet 14 with a loose connection, by way of example a screw connection, the two planing tool parts can be made dismountable and interchangeable. In certain cases it may be desirable to provide the planing tool with a shorter front part or even substitute the front part by a plate corresponding the end wall 4 in order to make possible the planing in corners and similar.

According to an alternative embodiment the two guiding pins **5*a* in the rear part can be substituted by guiding pins attached to the front part, which guiding pins correspond the central guiding pin 7 illustrated in the drawing, which pin in the last mentioned embodiment is omitted, as is also the case with the bore 8 in the end wall of the rear part. In this connection the locking arm can by way of example exhibit a design, which is evident from FIG. 6, in which figure the arm is indicated with 20, and the two guiding pins are indicated with 27. The lower portion of the locking arm 20 comprises a plate 20***a*, which is pivotably mounted around an axis 29. The plate suitably exhibits a circular outer contour, which on opposite sides passes to recesses 31, which make possible that the heads of the guiding pins can pass by the plate 20*a* in a pivoting position of the arm 20, while the plate is engaging the guiding pins on the rear side in the pivoting position illustrated in FIG. 6. As an additional alternative embodiment the plate 20*a* can exhibit an outer contour, the diameter of which exceeds the distance between the limits of the guiding pins 27 farthest away from each other, two key hole like openings corresponding the pins being made in the plate, which holes suitably can have the same shape as the opening 11 in the arm 10 illustrated in FIG. 4.

The planing tool can suitably be delivered together with cutting bits of a number of different designs for different depths of cut. This gives it the advantage compared with conventional planing tools that any adjustment with respect to the cutting depth will not be required. Thanks to the dismountable and/or hinged connection in between the two principal parts, any shavings stuck in the shavings slit 15 can easily be removed by separating said parts. Compared with conventional planing tools the now proposed design is of a very low construction, which among other things gives good possibilities of a suitable design and positioning of the rear handle 17.

The invention is not limited to the embodiments described above and illustrated in the drawings, but the planing tool can be varied as to its details within the scope of the subsequent claims without therefore departing from the fundamental idea of the invention. By way of example it is within the scope of the invention to make the planing tool in two parts without the hinge connecting the same.

I claim:

1. Planing tool, preferably for use with one time bits, comprising a front part and a rear part, said front part having a rearwardly facing surface and said rear part having a forwardly facing surface, said parts being pivotally connected with each other so that said surfaces are pivotable towards and away from each other, said surfaces having an inclination in the direction of forward push of the planing tool which substantially corresponds to the desired inclination of a bit to be used with said tool, and said surfaces further having means for fixing a bit, said surfaces, and consequently said parts of the planing tool relative to each other, and means for the mutual pressing together of said surfaces whereby said parts of the planing tool are held together with the bit clamped and fixed with respect to its position between said surfaces.

2. Planing tool according to claim 1, wherein at least one of said parts has a U-shaped cross-section, the surface associated with said one part being formed by an end wall closing one end of the groove formed by the U-shape of said part.

3. Planing tool according to claim 1, wherein said means for fixing the bit and surfaces relative to each other comprises pins projecting from one of said surfaces and corresponding holes in the other surface and bit, said pins extending through said holes.

4. Planing tool according to claim 1, wherein said means for pressing said surfaces together comprises at least a pin projecting from one of said surfaces and a hole corresponding to said pin in the other surface, and a locking means associated with said other surface adjustable in the working condition of the planing tool to engage said pin.

5. Planing tool according to claim 4, wherein said pin has a transverse groove in the side thereof, and said locking means comprises an arm pivotable on said other surface between a free position and locked position engaging said groove.

6. Planing tool according to claim 5, wherein a portion of said arm has a keyhole-like opening, the wider part of which has a width exceeding and the narrower part of which has a width smaller than the diameter of the portion of the pin located outside of said groove.

7. Planing tool according to claim 6, wherein the transition between the two parts of said keyhole-like opening is wedge-shaped.

8. Planing tool according to claim 4, wherein there is provided two of said pins located at a distance from each other, and said locking means comprises an arm pivotable around a pivoting axis on said other surface located between said pins, said arm having engaging portions located on opposite sides of said axis and being adjustable in the working condition of the planing tool to engage said pins.

9. Planing tool according to claim 8, wherein the part of said arm forming said engaging portions has the shape of a plate with keyhole-like openings for dismountable engaging cooperation with said pins.

10. Planing tool according to claim 1, wherein said two parts of the planing tool are hingedly connected on an axis extending in the upper portion of the planing tool in a tranverse direction to the same and parallel to its underside.

* * * * *